US011814772B2

(12) United States Patent
Kessler et al.

(10) Patent No.: US 11,814,772 B2
(45) Date of Patent: Nov. 14, 2023

(54) DEVICE COMPRISING AN OUTPUT MODULE AND/OR A SENSOR MODULE

(71) Applicant: Henkel AG & Co. KGaA, Duesseldorf (DE)

(72) Inventors: Arnd Kessler, Monheim am Rhein (DE); Lars Zuechner, Langenfeld (DE); Robert Ruiz Hernandez, Duesseldorf (DE); Ingo Hardacker, Hamminkeln (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 253 days.

(21) Appl. No.: 16/976,985

(22) PCT Filed: Mar. 7, 2019

(86) PCT No.: PCT/EP2019/055746
§ 371 (c)(1),
(2) Date: Aug. 31, 2020

(87) PCT Pub. No.: WO2019/170821
PCT Pub. Date: Sep. 12, 2019

(65) Prior Publication Data

US 2021/0002810 A1 Jan. 7, 2021

(30) Foreign Application Priority Data

Mar. 9, 2018 (DE) ..... 10 2018 203 587.3

(51) Int. Cl.
*D06F 33/37* (2020.01)
*D06F 39/02* (2006.01)
(Continued)

(52) U.S. Cl.
CPC ..... *D06F 33/37* (2020.02); *D06F 39/024* (2013.01); *D06F 2103/04* (2020.02); *D06F 2103/18* (2020.02); *D06F 2105/42* (2020.02)

(58) Field of Classification Search
CPC ..... D06F 39/024
See application file for complete search history.

(56) References Cited

U.S. PATENT DOCUMENTS

2003/0182732 A1 10/2003 Davenet et al.

FOREIGN PATENT DOCUMENTS

CN 101415876 A 4/2009
CN 101854843 A 10/2010
(Continued)

OTHER PUBLICATIONS

DE102010028354A1 Machine Translation (Year: 2011).*
EPO, International Search Report issued in International Application No. PCT/EP2019/055746, dated Jul. 16, 2019.

*Primary Examiner* — Spencer E. Bell
(74) *Attorney, Agent, or Firm* — Lorenz & Kopf, LLP

(57) ABSTRACT

A device for use in a household appliance is disclosed, the device comprising: at least one casing, wherein the casing is configured to be placed in a treatment chamber of a household appliance; wherein the casing comprises at least one output module, which is configured to dispense at least one preparation into the treatment chamber of the household appliance and/or to trigger an output; and at least one sensor module, which is configured to determine sensor data characteristic of the condition of the treatment chamber of the household appliance and/or of the device; wherein the sensor module comprises at least one sensor, wherein the sensor data at least partially represents information determined by employing the at least one sensor; wherein the data determined by sensor is at least partially indicative of a load
(Continued)

condition of the treatment chamber of the household appliance.

17 Claims, 4 Drawing Sheets

(51) Int. Cl.
*D06F 105/42* (2020.01)
*D06F 103/18* (2020.01)
*D06F 103/04* (2020.01)

(56) References Cited

FOREIGN PATENT DOCUMENTS

| | | | |
|---|---|---|---|
| CN | 202273113 | U | 6/2012 |
| CN | 105088679 | A | 11/2015 |
| CN | 105518548 | A | 4/2016 |
| DE | 102006038341 | A1 | 2/2008 |
| DE | 102007042863 | A1 | 3/2009 |
| DE | 102010028354 | A1 | 12/2011 |
| DE | 102016212979 | A1 | 1/2018 |
| MX | 2011000344 | A | 3/2011 |
| WO | 0229150 | A1 | 4/2002 |
| WO | 2011131256 | A1 | 10/2011 |
| WO | 2011134690 | A1 | 11/2011 |

* cited by examiner

DEVICE COMPRISING AN OUTPUT MODULE AND/OR A SENSOR MODULE

CROSS-REFERENCE TO RELATED APPLICATION

This application is a U.S. National-Stage entry under 35 U.S.C. § 371 based on International Application No. PCT/EP2019/055746, filed Mar. 7, 2019, which was published under PCT Article 21(2) and which claims priority to German Application No. 10 2018 203 587.3, filed Mar. 9, 2018, which are all hereby incorporated in their entirety by reference.

TECHNICAL FIELD

The present disclosure relates to a device for use in a domestic appliance, the device comprising at least one output module and at least one sensor module.

BACKGROUND

Devices and methods for controlling and/or regulating household appliances such as washing machines or tumble dryers are known from the state of the art. The aim in operating such household appliances is typically to achieve a high degree of user-friendliness and at the same time the best possible result (in the case of a washing machine, in particular, the most immaculate cleaning result possible).

If, for example, increased soiling is to be taken into account, a user must take this into account manually, for example, and select an appropriate program or detergent. Approaches are known in which parameters of the household appliance are automatically adjusted in order to achieve the best possible result. For example, parameters of the household appliance are configured to parameters defined by the detergent used. For example, the washing program of a washing machine is configured to the detergent used.

The disadvantage is that in many situations and scenarios the result to be achieved is still in need of improvement.

BRIEF SUMMARY

This disclosure provides a device for use in a household appliance, the device including:

at least one casing, wherein the casing is configured to be placed in a treatment chamber of a household appliance;

wherein the casing comprises:

at least one output module, which is configured to dispense at least one preparation into the treatment chamber of the household appliance and/or to trigger an output;

and at least one sensor module which is configured to determine sensor data related to the condition of the treatment chamber of the household appliance and/or the device;

wherein said sensor module comprises at least one sensor, wherein said sensor data at least partially representing data determined by said at least one sensor, wherein said at least one sensor is a magnetic field sensor;

wherein the data determined by the sensor is at least partially indicative of a load condition of the treatment chamber of the household appliance; and wherein the dispensing and/or the triggering of the output of the preparation by the at least one output module is at least partially based on the sensor data.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
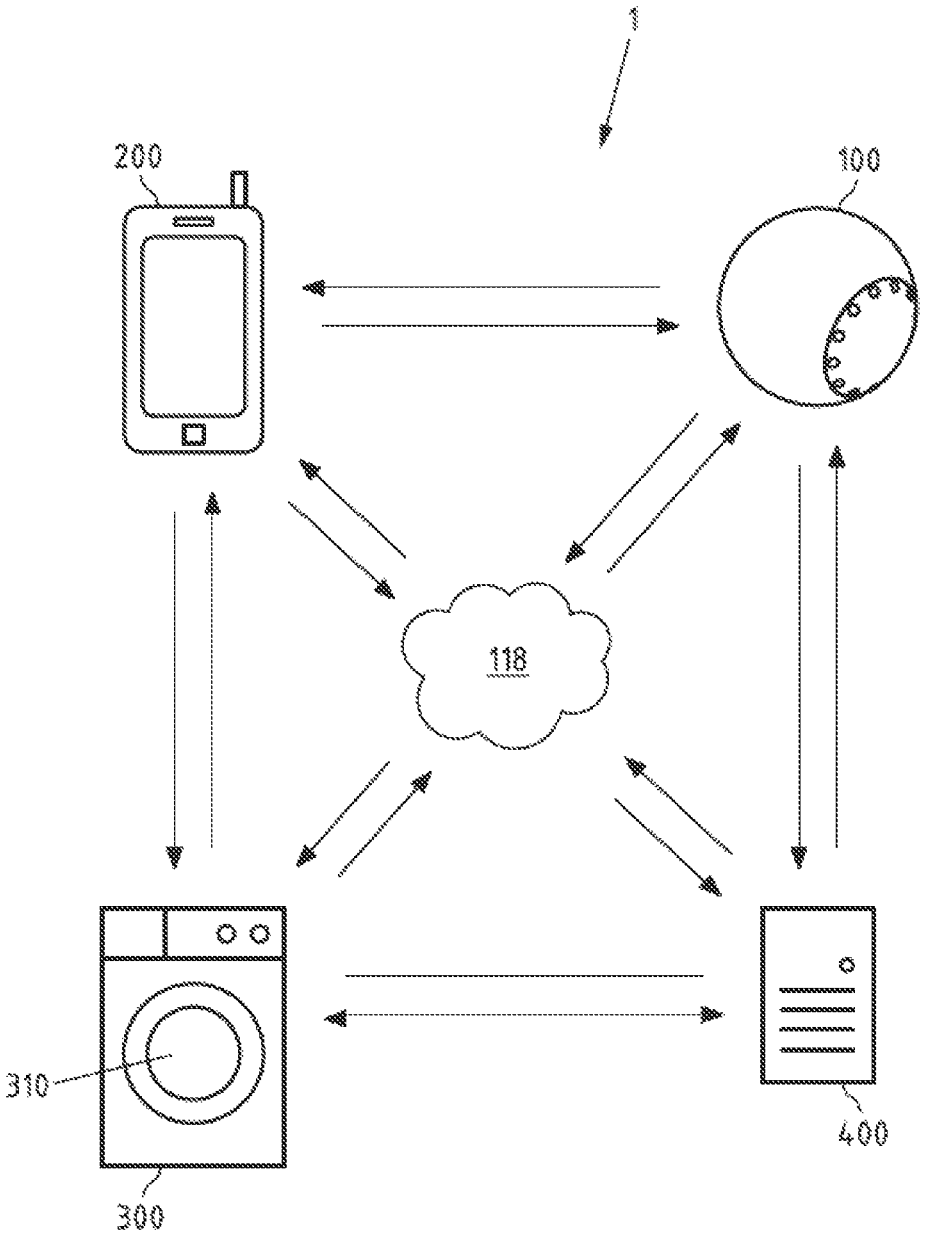
FIG. 1 shows a schematic representation of an embodiment of a system as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

Against the background of the state of the art as presented, the task of the present disclosure is to variably improve the result to be achieved with a household appliance with respect to the many possible situations and scenarios and to ensure the highest possible reliability of the devices used.

According to a first aspect of the present disclosure, a device for use in a household appliance is disclosed, the device comprising at least one casing, wherein the casing is configured to be placed in a treatment chamber of a household appliance;

wherein the casing comprises:

at least one output module which is configured to dispense at least one preparation into the treatment chamber of the household appliance and/or to trigger an output;

and at least one sensor module which is configured to determine sensor data characteristic of the condition of the treatment chamber of the household appliance and/or the device;

wherein the sensor module comprises at least one sensor, the sensor data at least partially representing data determined by employing the at least one sensor;

wherein the data determined by the sensor is at least partially indicative of a load condition of the treatment chamber of the household appliance; and wherein the dispensing and/or the triggering of the output of the preparation by the at least one output module is at least partially based on the sensor data.

For the purposes of the present disclosure, "household appliance" means household appliances for textile treatment, in particular textile washing machines, tumble dryers or ironing devices. Dishwashing appliances, such as dishwashers, are not household appliances within the meaning of the present disclosure.

According to a second aspect of the present disclosure, a device for use in a household appliance is disclosed, said device comprising: at least one casing, said casing being configured to be placed in a treatment chamber of a household appliance; said casing comprising: at least one sensor module, which is configured to determine sensor data characteristic of the condition of the treatment chamber of the household appliance and/or the device; wherein the sensor module comprises at least one sensor, wherein the sensor data at least partially represents data determined by employing the at least one sensor; wherein the data determined by the sensor is at least partially indicative of a load condition of the treatment chamber of the household appliance; and wherein the dispensing and/or the triggering of the output of the preparation by the at least one output module takes place at least partially based on the sensor data.

According to the first and/or second aspect of the present disclosure, a device is disclosed for use in a household appliance, said device comprising: at least one casing, said casing being configured to be placed in a treatment chamber of a household appliance; wherein said casing comprises at least one output module which is configured to deliver at least one preparation into the treatment chamber of the household appliance and/or to trigger an output; and/or at least one sensor module which is configured to determine sensor data characteristic of the condition of the treatment chamber of the household appliance and/or of the device; wherein the sensor module comprises at least one sensor, wherein the sensor data at least partially represents data determined by employing the at least one sensor; wherein the data determined by the sensor is at least partially indicative of a load condition of the treatment chamber of the household appliance; and wherein the dispensing and/or the triggering of the output of the preparation by the at least one output module is at least partially based on the sensor data.

The device according to the first aspect of the present disclosure is, for example, a dosing device for dispensing a preparation comprising treatment agents, fragrances, detergents and/or cleaning agents. The device according to the second aspect of the present disclosure is for example a sensor device for detecting sensor data concerning the treatment process (e.g. cleaning program) in the household appliance. The device according to the first and second aspect is, for example, a dosing device in combination with a sensor device comprising at least one sensor, in particular in a common casing.

According to the first aspect of the present disclosure a method using one or more devices according to the first aspect is further disclosed, the method comprising: detecting and/or obtaining output data (e.g. comprising the sensor data) at the output module; and determining and/or effecting the determination of output control data at least partially dependent on the output data, the output control data being in particular representative of at least one property of a storage container for a preparation, an application specification for a preparation contained in the storage container and/or a property of a preparation contained in the storage container, the output control data being configured to at least partially control the output of the preparation by the output module.

According to the second aspect of the present disclosure, a method using one or more devices according to the second aspect is further disclosed, the method comprising: detecting and/or obtaining on the sensor module sensor data characteristic of the condition of a treatment chamber of the household appliance; determining and/or effecting the determination of output data at least partially dependent on the sensor data; and outputting and/or triggering the output of the output data.

According to the first and second aspect of the present disclosure, a method using one or more devices according to the first aspect and one or more devices according to the second aspect is also disclosed.

According to a third aspect of the present disclosure, a system comprising a device according to the first and/or second aspect of the present disclosure is disclosed, the system further comprising at least one household appliance, for example a washing machine or a tumble dryer. The system according to the third aspect may comprise further devices and/or elements, for example a communication network and/or a server.

Employing the device according to the first and/or second aspect and the system according to the third aspect of the present disclosure may comprise hardware and/or software components. The elements may, for example, comprise at least one memory containing program instructions of a computer program and at least one processor configured to execute program instructions from the at least one memory. Accordingly, according to the first and second aspect of the present disclosure, also a device comprising at least one processor and at least one memory with program instructions shall be understood as disclosed, wherein the at least one memory and the program instructions are adapted to cause, together with the at least one processor, the output module and the sensor module, respectively, to execute and/or control the method according to the first aspect and the second aspect of the present disclosure, respectively.

Alternatively or in addition, the employing the device according to the first and/or second aspect may further comprise one or more further sensors and/or one or more communication interfaces.

A communication interface should be understood to mean, for example, a wireless communication interface and/or a wired communication interface.

A wireless communication interface is for example a communication interface according to a wireless communication technology. An example for a wireless communication technology is a local radio network technology such as Radio Frequency Identification (RFID) and/or Near Field Communication (NFC) and/or Bluetooth (e.g. Bluetooth Version 2.1 and/or 4.0) and/or Wireless Local Area Network (WLAN). RFID and NFC, for example, are specified according to ISO standards 18000, 11784/11785 and ISO/IEC standards 14443-A and 15693. WLAN, for example, is specified in the standards of the IEEE 802.11 family Another example of a wireless communication technology is a supra-local radio network technology such as a mobile radio technology, for example Global System for Mobile Communications (GSM) and/or Universal Mobile Telecommunications System (UMTS) and/or Long Term Evolution (LTE). GSM, UMTS and LTE specifications are maintained and developed by 3rd Generation Partnership Project (3GPP).

A wired communication interface is, for example, a communication interface according to a wired communication technology. Examples of a wired communication technology are a Local Area Network (LAN) and/or a bus system, for example a Controller Area Network bus (CAN bus) and/or a Universal Serial Bus (USB). CAN bus, for example, is specified according to ISO standard ISO 11898. LAN, for example, is specified in the standards of the IEEE 802.3 family. It is understood that the output module and/or the sensor module may also include other elements not listed.

Furthermore, according to the first, second and/or third aspect of the present disclosure, a computer program is disclosed comprising program instructions adapted to cause a device to execute and/or control the method according to the first and/or second aspect or the system according to the third aspect when the computer program is executed by a processor.

Furthermore, a computer-readable storage medium containing a computer program according to the first, second and/or third aspect of the present disclosure is disclosed. A computer-readable storage medium may, for example, be in the form of a magnetic, electrical, electro-magnetic, optical and/or other type of storage medium. Such computer-readable storage medium is preferably tangible (i.e. "touchable"), for example, it is designed as a data storage device. Such a data storage device is, for example, portable or permanently installed in a device. Examples of such data storage devices are volatile or non-volatile Random Access Memories (RAM) such as NOR flash memories or sequential access memories such as NAND flash memories and/or Read-Only Memories (ROM) or read-write memories. Computer-readable shall be understood to mean, for example, that the storage medium may be read and/or written by a computer or server device, such as a processor.

In the following, the features of the devices and methods according to the first and second aspect or the system according to the third aspect of the present disclosure are described, some of them as examples.

A household appliance is understood to be in particular a washing machine, in particular also a (laundry) dryer and/or an ironing device. Corresponding household appliances may have a treatment chamber which is equipped to receive objects such as textiles and to subject them to a treatment inside the treatment chamber, for example cleaning, drying and/or ironing.

The casing is designed to be placed in a treatment chamber of a household appliance and has, in particular, an appropriate size which allows the casing or device to be removed at least partially from the treatment chamber. In particular, the casing or device may be placed loosely and/or without fasteners in the treatment chamber. In the case of a washing machine or dryer, for example, the casing or device is to be placed in and/or removed from the treatment chamber together with the objects to be cleaned. The casing of the device encloses in particular some or all of the employing the device partially or completely. In particular, the casing is designed to be watertight so that some or all of the employing the device do not come into contact with water when the device is placed in a treatment chamber, for example, the treatment chamber of a washing machine, and in particular during a treatment.

The device or casing referred to in the first and/or second aspect is in particular a mobile and/or portable device and/or a device distinct from the household appliance. A mobile and/or portable device shall be understood to mean, for example, a device whose external dimensions are less than about 30 cm×30 cm×30 cm, preferably less than about 15 cm×15 cm×15 cm. A device other than a household appliance is for example a device which has no functional connection with the household appliance and/or is not a part permanently connected to the household appliance. For example, a device which is mobile and/or portable and different from a household appliance is a device which is placed (e.g. inserted) by a user in the washing and/or cleaning area of the household appliance (e.g. the washing drum of a washing machine) for the duration of a treatment process (e.g. cleaning program). An example of such a mobile and/or portable device as well as a device other than a household appliance is a dosing device and/or sensor device which is placed in the washing drum of a washing machine before the start of the washing process. For example, the output module and/or sensor module is part of such a dosing device and/or sensor device according to the first and/or second aspect of the present disclosure.

The casing may have at least one output module which is designed to dispense at least one preparation into the treatment chamber of the household appliance and/or to trigger an output. The output of a preparation, for example, comprising detergent and/or cleaning agents, is to be understood, for example, as meaning that the preparation is output to the environment of the output module and/or a storage container for the preparation. The output is carried out, for example, by the output module. Alternatively or additionally, output may be affected by the output module, e.g. the output module causes the preparation to be output through the storage container. For example, the output module causes the preparation to be output through an output opening of the output module and/or the storage container to the environment of the output module and/or the storage container.

The casing has at least one sensor module which is configured to determine at least one piece of sensor information characteristic of the condition of the treatment chamber of the household appliance and/or the device. Such sensor data may, for example, be at least one parameter of conductivity (for example, a substance in the treatment chamber such as water and/or a washing or cleaning solution or liquor).

The sensor data comprises, for example, the data determined by the at least one sensor. Accordingly, the sensor data may, in particular, comprise further data acquired, for example, by further one or more sensors included in the sensor module (e.g. temperature sensor, optical sensor, acceleration sensor, or a combination thereof, to name but a few non-limiting examples).

The data acquired by the at least one sensor is at least partially indicative of a load condition of the treatment chamber of the household appliance. The load condition is exemplified by a load quantity of objects that may be placed in the treatment chamber of the household appliance. The load condition of the treatment chamber of the household appliance is represented, for example, by the fact that the determined data represents a full, quarter full, half full, three quarter full or empty treatment chamber of the household appliance. Additionally or alternatively, the load condition may be represented by a percentage, e.g. from 0% to about 100%.

The dispensing and/or triggering of the output of the preparation by the at least one output module is at least partially based on the sensor data. If the data acquired by the sensor represents, for example, an empty treatment chamber of the household appliance, the dispensing and/or triggering of the output of the preparation may be prevented until, for example, a threshold value of a load quantity of the treatment chamber is exceeded by the household appliance. The threshold value may, for example, reflect an energy cost analysis, where, for example, energy and/or water to be consumed to run a cleaning program by the household appliance justifies running it.

In a configuration according to all aspects of the present disclosure, the data acquired by the at least one sensor is at least partially indicative of a status of a cleaning program performed by the household appliance.

The status of the cleaning program performed by the household appliance represents, for example, an identification of that status of the cleaning program which corresponds, for example, to the current and performed step of the cleaning program by the appliance. This may be carried out at least partially based on the data acquired by the sensor or on several items of information acquired by the acceleration sensor, reflecting or comprising one or more parameters characterizing the condition of the treatment chamber of the household appliance. A parameter characterizing the condition of the treatment chamber of the household appliance further represents, for example, a temperature, a liquid level (e.g. water), a number of revolutions of the treatment chamber of a household appliance designed as a washing machine, just to name a few non-limiting examples.

At least partly based on the determined status of the cleaning program carried out by the household appliance, it is possible, for example, to control and/or regulate the device or to determine a possible control and/or regulation of the device intended to be carried out. For example, a control and/or regulation of the device may be carried out or a possible control and/or regulation of the device intended to be carried out may be determined, at which point in time (date, time, step of the cleaning program, or the like) a dispensing or triggering of an output of the at least one preparation (e.g. cleaning agent), a consideration of the nature and/or type (e g manufacturer and appliance identification number) of the household appliance, and/or whether or not a dispensing or triggering of an output of the at least one preparation (e.g. cleaning agent) should take place when a step of the cleaning program (e.g. rotating of the treatment chamber in a household appliance designed as a washing machine) should take place or not.

For this purpose, a query may be made, for example, to the database, in which, for example, relevant historical data is stored. On the basis of this historical data, the control and/or regulation of the device may be carried out or a possible control and/or regulation of the device intended to be carried out may be determined. The use of historical data may in particular be combined with the use of an artificial neural network. Further details on the use of an artificial neural network are described below.

For example, according to the first and/or the second aspect of the present disclosure, the method comprises acquiring and/or obtaining at the sensor module sensor data characteristic of the condition of a treatment chamber of the household appliance, and determining and/or effecting the determination of output data at least partially dependent on the sensor data. The sensor data also represents, for example, measured values of one or more physical and/or chemical variables which are characteristic of the condition of the treatment chamber and/or the device, for example of the washing and/or cleaning process, such as a temperature of the washing and/or cleaning liquor, a duration of the washing and/or cleaning process and/or a concentration of washing and/or cleaning agents in the washing and/or cleaning liquor. From these measured values, for example, a status of a cleaning program carried out by the household appliance may be derived at least in part. If, for example, there is water, washing and/or cleaning liquor or the like in the treatment chamber, the implementation of the cleaning program of the household appliance is not yet complete.

In a further configuration according to all aspects of the present disclosure, the data determined by the at least one sensor is at least partially indicative of a fluid level of the treatment chamber of the appliance.

The data determined by the at least one sensor represents, for example, whether or not the treatment chamber of the household appliance is filled with a liquid, such as water, washing and/or cleaning liquor or the like. In addition, the data determined by the at least one sensor may represent how much liquid is contained in the treatment chamber, e.g. whether or not further liquid may be added to the treatment chamber, and/or may be an indication in percent of the maximum possible capacity of the household appliance to absorb liquid into the treatment chamber. The amount of liquid used to carry out a cleaning program may, for example, affect the quality of cleaning of items placed in the treatment chamber.

For example, in training cases, a low fluid level and the associated cleaning result and such a fluid level in the treatment chamber may be given, where the treatment chamber is completely filled with fluid, and then the sensor may be used to acquire data characterizing the respective condition. This data may, for example, be stored in a database as reference values. In the database it is also possible, for example, to define recommendations for dispensing and/or triggering the output of preparation into the treatment chamber depending on the condition of the treatment chamber of the household appliance, which ensures a particularly reliable cleaning result. In addition or alternatively, depending, for example, on the condition of the treatment chamber of the household appliance, recommendations for the cleaning program to be carried out by the household appliance may be included in the database. The data stored in the database or included in the database may be used, for example, to control and/or regulate both the device and the household appliance.

An embodiment according to all aspects of the present disclosure is exemplified in that the at least one sensor is a magnetic field sensor.

The sensor data may, for example, be determined or acquired by at least one magnetic field sensor. Such magnetic field sensor is also called a magnetometer. A magnetic field sensor is in particular a sensor device for measuring magnetic flux densities. Magnetic flux densities are measured in the unit Tesla (T).

If, for example, the determined sensor data represents an essentially uniform harmonic oscillation behavior (e.g. the curve represented by the sensor data equals or resembles such an oscillation behavior), this corresponds, for example, to a rotation of the treatment chamber of the household appliance. If the magnetic field sensor, independent of the spatial axis (e.g. x-, y-, and/or z-axis), determines such a curve progression, it may, for example, be clearly recognized that the treatment chamber of the household appliance is moving (e.g. a rotation of a drum of a washing machine). Accordingly, it may be determined that, for example, a cleaning program has started to be carried out by the household appliance and, accordingly, the device is definitely located inside the treatment chamber of the household appliance.

If, for example, the determined sensor data represents one or more pauses, through which, for example, a uniform harmonic oscillation behavior (e.g. the curve is equal or similar to such an oscillation behavior) is interrupted, the determined sensor data may be characteristic for a specific cleaning program carried out by the household appliance, so that the cleaning program carried out may be identified. These pauses may, for example, occur at certain intervals, also known as pause behavior, whereby these certain intervals of the pauses are characteristic of one of many possible cleaning programs that may be carried out by the household appliance. In this way, an identification (e.g. by employing an analysis and a database query in a so-called look-up table) of the cleaning program carried out by the household appliance may be concluded at least partially on the basis of such a pause behavior.

For example, in order to determine whether or not a spinning process is taking place within the course of a cleaning program carried out by a household appliance designed as a washing machine, or to determine the rotational speed of the treatment chamber (e.g. in the case of a washing machine, washer-dryer and dryer), the data determined by the magnetic field sensor may be evaluated in order to determine this. Here, for example, the rotational speed of the treatment chamber is at least approximately determined or specified (e.g. calculated) based at least in part on the duration of an oscillation amplitude (e.g. from a first zero crossing to a second zero crossing, or a frequency of such oscillation amplitudes, to name only a few non-limiting examples).

The course of the curve represented by the data may, for example, also be evaluated in such a way that, for example, in the case of a household appliance designed as a washing machine, a filling quantity or degree of filling (e.g. as a percentage of the maximum possible filling quantity of the treatment chamber set at about 100%) is determined.

In the event that, for example, there is no harmonic sine wave, this behavior is characteristic for a treatment chamber load of less than about 50% of the maximum possible treatment chamber load. With larger load quantities up to about 100% of the maximum possible load quantity of the treatment chamber, the behavior (or movement) of the device changes. This is represented, for example, by the curve of the sensor data determined. Inside the treatment chamber the movement of the device changes, whereby this is represented by the curve progression, which represents the oscillation behavior as a harmonic oscillation (e.g. a sinusoidal curve progression).

The sensor data is an oscillation behavior of the magnetic flux density measured by the magnetic field sensor. The load condition of the treatment chamber is determined by an analysis of the oscillation behavior, wherein a harmonic sinusoidal oscillation is detected as indicative of a drum loaded over about 50% and a disharmonic sinusoidal oscillation is detected as indicative of a drum loaded less than about 50%.

The magnetic field sensor may be configured to detect deviations of a few Gauss. Such variations are of the same order of magnitude or less than the value of the earth's magnetic field.

A configuration according to all aspects of the present disclosure at least one sensor is a conductivity sensor.

A conductivity sensor is understood to be a sensor which in particular acquires data indicative of the conductivity of liquids and in particular of aqueous solutions or electrolytes or water of varying purity. In addition, a conductivity sensor may, in particular, be used to represent whether or not a liquid is present in the environment of the conductivity sensor.

Conductivity depends on one or more of the following parameters i) to iii):

i) the concentration of a dissolved substance in the liquid of the treatment chamber, the nature of its dissociation and/or a degree of dissociation;
ii) the valence and mobility in the liquid of the anions or cations formed; and
iii) the temperature of the liquid, with conductivity increasing regularly with increasing temperature.

For example, based on the knowledge of the data acquired by the conductivity sensor, whether or not liquid is placed in the treatment chamber of the household appliance, a (e.g. optimal) point in time for dispensing and/or triggering an output of the preparation may be controlled and/or regulated. Furthermore, based on the knowledge of the data acquired by the conductivity sensor, e.g. the concentration of a liquid, e.g. water, to which a cleaning and/or washing liquor has been added, it may be determined whether, e.g. further liquid (e.g. water) or further preparation should be added to the treatment chamber to increase the concentration of the cleaning and/or washing liquor.

Additionally or alternatively, the liquid level in the treatment chamber of the household appliance may be determined, e.g. by employing a comparison with a determined (e.g. measured) concentration of active substances by the conductivity sensor. This may result, for example, in improved cleaning of objects in the treatment chamber at least partially based on the dosage of preparation, the dosage determining a dilution of the preparation, e.g. by water in the treatment chamber of the household appliance.

Furthermore, the sensor module may comprise more than one conductivity sensor. This may, for example, make it possible to determine one or more of the following data at least partially based on the data acquired by the more than one conductivity sensor:

A degree of soiling of objects in the treatment chamber may be determined by, for example, a first item of information representing a liquid detected by one of the conductivity sensors when the liquid is added to the treatment chamber of the household appliance and a second item of information representing the liquid detected by another conductivity sensor when the liquid leaves the treatment chamber of the household appliance. From a certain difference between the first data and the second data it is possible, for example, to infer a degree of soiling of the objects in the treatment chamber. This principle may also be used to determine the rinsing properties of the household appliance. If, for example, a cleaning program has been completely carried out by the household appliance, clear water may, for example, be fed into the treatment chamber, which flows around the objects in the treatment chamber. The water that then leaves the treatment chamber may be measured again by a conductivity sensor. If, for example, no degree of soiling is found in the water flowing out of the treatment chamber, the cleaning process was successful carried out by the cleaning program.

In addition, it is possible, for example, to determine whether a cleaning program has been completed or ended by employing data acquired from a conductivity sensor. For example, the data acquired by the conductivity sensor may be used to count the number of rinsing cycles that have been carried out. These may, for example, be compared with the number of rinsing cycles planned by the cleaning program. If, for example, there is a difference in the results, the cleaning program has not yet been completely carried out by the household appliance, or an error has occurred. In addition, this type of data acquired by the conductivity sensor may be used, for example, to determine whether the last rinse cycle to be carried out by the cleaning program is being carried out. In this case, for example, the dispensing or triggering of an output of preparation, such as a cleaning agent, may be suppressed.

A further configuration according to all aspects of the present disclosure sensor data further at least partially represents data determined by employing one or more further sensors, the one or more further sensors being one or more of the following sensors: temperature sensor, optical sensor, and acceleration sensor.

For example, the sensor module further comprises an acceleration sensor (accelerometer) and a temperature sensor (for example a thermocouple). The sensor module may further comprise, for example, a mechanical sensor (e.g. a pressure sensor) and/or an optical sensor (e.g. a CCD sensor). In addition to an optical sensor, the sensor module may further comprise a light generating element adapted to generate light in the visible and/or non-visible range. An example of a light generating element is a Light Emitting Diode (LED). For example, the sensor module may also include more than one type of sensor (e.g. temperature sensor, or acceleration sensor).

An acceleration sensor is a sensor that measures its acceleration. This is done, for example, by determining the inertial force acting on a mass of the acceleration sensor. Thus it may be determined, for example, whether there is an increase or decrease in speed.

An acceleration sensor, for example, may represent a motion sensor. A motion sensor of this type may detect a change in position, for example. For example, a movement may be detected by employing an acceleration sensor in such a way that movements are calculated as an integration of detected data (e.g. measured values) from an acceleration sensor. For example, a position determination of the device, e.g. in the treatment chamber of the household appliance, may be carried out in this way.

The data acquired by the acceleration sensor represents, for example, an acceleration and/or movement of the device. Furthermore, the data acquired by the acceleration sensor represents, for example, a certain position of the device.

The data determined by the acceleration sensor may, for example, be at least partially indicative of the load status of the household appliance. The data determined by the acceleration sensor represents, for example, whether or not the treatment chamber of the household appliance is loaded. In addition, the data determined by the acceleration sensor may represent how full (e.g. as a percentage of the maximum possible capacity) the treatment chamber of the household appliance is loaded (or filled). If the data determined by the acceleration sensor exemplifies a relatively frequent movement of the device (e.g. little movement within a time interval, e.g. of about 5 seconds; e.g. more than one movement per second), it is possible, for example, to determine that the treatment chamber of the household appliance is correspondingly low loaded. If the data determined by the acceleration sensor exemplifies a relatively rare movement of the device (e.g. only one movement per second), it may, for example, be determined that the treatment chamber of the household appliance is fully loaded. In training cases, for example, there may be a lightly loaded and a fully loaded treatment chamber, and by employing the acceleration sensor, corresponding data characterizing the respective condition may be acquired. This data may be stored in a database as reference values, for example. In addition, the database may also define recommendations for dispensing and/or triggering the output of preparation into the treatment chamber, for example, depending on the condition of the treatment chamber of the household appliance, which ensure a particularly reliable cleaning result. In addition or alternatively, depending, for example, on the condition of the treatment chamber of the household appliance, recommendations for the cleaning program to be carried out by the household appliance may also be included in the database. The data stored in the database or included in the database may be used, for example, to control and/or regulate both the device and the household appliance.

An optical sensor is a sensor that is able to detect optical data, such as light, as data. For example, an LED as an optical sensor may both emit and detect light. A load condition of the treatment chamber of the household appliance may be determined by at least one transmitter LED and an optical sensor comprising at least one receiver LED. If the transmitter LED and receiver LED are identical in design, a transmission or attenuation of the radiation due to the prevailing load of the treatment chamber of the household appliance may be determined in a particularly simple and direct way. The receiver LED may, for example, be located outside the device, e.g. in the treatment chamber of the household appliance. Likewise, a configuration of transmitter LED and receiver LED in a reflection or emission measurement may be intended.

Furthermore, an optical sensor is further understood to be, in particular, a sensor which may determine an intensity of incident radiation, in particular electromagnetic radiation in the visible range and, alternatively or additionally, in a non-visible range. The optical sensor may include an image sensor, in particular a digital image sensor. In particular, at least one semiconductor element, diodes, CCD elements, for example a Bayer sensor, or CMOS elements, for example a Foveon X3 type sensor, may be used to determine the intensity of the radiation. The optical sensor may contain optical filters and in particular a spectrometer. It is also conceivable to use monochrome sensors without color resolution. Optical sensors limited to certain wavelength ranges may also be used. For example, the optical sensor may be based on at least one photo diode and/or at least one LED element. Single elements or arrays of elements, for example, photo diodes or light-sensitive components such as LEDs may be used. It may be advantageous to optimize the size of the individual sensors, for example the individual photo diodes, in terms of dynamics, resolution and/or sensitivity.

For example, one optical sensor comprises at least one camera-like element and provides image data. Accordingly, digital cameras may be used as optical sensors for the device.

By employing an optical sensor, data may be acquired in particular which indicates cloudiness, soiling and/or color of objects in the treatment chamber of the household appliance.

A temperature sensor is a sensor that acquires data indicative of the temperature in the vicinity of the temperature sensor.

For example, depending on data detected by a temperature sensor, which represents a prevailing temperature in the treatment chamber of the device, an (optimum) point in time for dispensing and/or triggering the output of preparation into the treatment chamber of the household appliance may be determined. For example, a preparation unfolds a particularly effective cleaning action especially at a predetermined temperature.

If several sensors are included in the sensor module, they may be dedicated or included together, e.g. by the sensor module, i.e. they may be designed, for example, as a unit together with the sensor module, or they may be at least electrically connected to the sensor module, so that data acquired in particular by the respective sensor, i.e. the temperature sensor, the conductivity sensor, the optical sensor, or a combination thereof, may be transmitted to the sensor module, and the sensor module may determine the sensor data accordingly.

The sensor module may also include one or more of the following sensors (i) to (iv):

i) pH sensor;

ii) surfactant sensor;

iii) surface sensor; and iv) acoustic sensor.

A pH sensor is an electro-chemical sensor which, for example, carries out a quantitative determination of ions in a liquid. This is done, for example, by employing an electrical current potential, so that, for example, a change in the existing pH value of a liquid (e.g. when the liquid is fed into the treatment chamber and removed from the treatment chamber of the household appliance) may be detected.

A surfactant sensor is, for example, a sensor that is able to detect a surface tension of a liquid (e.g. water) as data.

A surface sensor is understood to be a sensor which is configured on a surface of the sensor module for detecting data indicative of stress, strain, elasticity and/or friction acting on the device in the treatment chamber.

An acoustic sensor is understood to be a sensor which is capable of detecting acoustic data. Such an acoustic sensor includes or is for example a microphone. The data acquired by the acoustic sensor may, for example, represent sounds. Data acquired by the acoustic sensor is, for example, indicative of a mechanical condition of the device and/or the household appliance, in particular the treatment chamber of the household appliance. Unusual noises may, for example, indicate a defect in the device and/or the household appliance. Furthermore, data acquired by the acoustic sensor may be indicative of a load condition of the treatment chamber and/or of a liquid level in the treatment chamber of the household appliance.

The above-mentioned sensors, or at least one of these above-mentioned sensors (acceleration sensor, optical sensor, temperature sensor, pH sensor, surfactant sensor, surface sensor, and/or acoustic sensor) may be used in particular for verifying the data acquired by the at least one sensor.

It may, for example, be verified by employing an acceleration sensor whether, for example, a cleaning program of the household appliance which has been carried out is finished or not, since in this case, for example, data acquired by the acceleration sensor represents that there is no (further) movement of the device.

An embodiment according to all aspects of the present disclosure provides that the output module and/or the sensor module are configured to communicate with the household appliance, in particular to communicate wirelessly with the household appliance.

A further embodiment according to all aspects of the present disclosure provides that the output module and/or the sensor module are configured to perform and/or prevent communication with the household appliance at least based on the sensor data acquired by the sensor module.

The output module and/or the sensor module, which are adapted to communicate with the household appliance, may, for example, communicate with the household appliance by employing the communication interface covered by the device. The communication interface is in particular designed to communicate wirelessly with the household appliance. The output module may also be configured to communicate with the sensor module, in particular wirelessly.

In a further embodiment of the device according to the first and/or second aspect, the output module and/or the sensor module is set up to carry out and/or prevent communication with the household appliance at least based on the sensor data acquired by the sensor module.

In an embodiment according to all aspects of the present disclosure, the communication with the household appliance comprises a transmission of feedback data, wherein the feedback data is indicative of a feedback to the household appliance with respect to at least one parameter characterizing the treatment chamber of the household appliance.

The feedback data comprises or represents for example one or more of the following parameters i) to iii):

i) data indicative of a mechanical condition of the appliance;

ii) data indicative of a load condition of the treatment chamber of the household appliance; and iii) data indicative of a recommendation of a cleaning program to be carried out or of a modification of a program carried out on the household appliance.

The feedback data may be used to control and/or regulate, for example, the dispensing of at least one preparation into the treatment chamber of the household appliance or to trigger such output. This may be done, for example, in such a way that the household appliance takes the feedback data into account. For example, such a cleaning program of the household appliance may be selected, or an already selected cleaning program of the household appliance may be adapted, which takes into account the load condition of the treatment chamber. For example, a cleaning program that carries out particularly intensive cleaning may be selected if, for example, the treatment chamber is particularly fully loaded.

Alternatively or in addition, a recommendation for a cleaning program to be carried out may be given, for example, via a display device on the household appliance, or to a display or comprehensive electronic device (e.g. a mobile device such as a smartphone, tablet, or wearable, to name but a few non-limiting examples). On the basis of the output, a user may, for example, manually select an appropriate cleaning program or change an already selected cleaning program (e.g., change the temperature, duration, or other special parameters (e.g., spin speed of a washing machine-type household appliance, to name a few non-limiting examples)). This makes it possible in particular to use the device with household appliances that cannot be controlled and/or regulated automatically.

The feedback data may, for example, also cause the household appliance to be controlled and/or regulated, such as switching the household appliance on and/or off. With regard to switching the household appliance on and/or off, it may, for example, influence whether (at all) the household appliance is switched on and/or off and/or at what time (time, date, or e.g. immediately) the household appliance is switched on and/or off. For example, the feedback data based on the specific sensor data may cause such a feedback to the household appliance that the household appliance knows that, for example, the treatment chamber of the household appliance is fully (or almost fully) loaded. In addition, the feedback data may additionally provide the household appliance with data on the nature of the load (e.g. laundry, color of the laundry, or a combination thereof, to name but a few non-limiting examples), so that it is possible to influence the selection, composition and/or dosing of a cleaning program to be carried out by the household appliance and/or a cleaning agent to be used for the household appliance. For example, the amount to be dosed (e.g. the amount of detergent in a washing machine), the time of dosing, the product to be dosed, or individual ingredients (e.g. soil release polymers, bleaches, enzymes, hygiene rinse aids in a washing machine, to name but a few non-limiting examples) or combinations thereof may be influenced. The compatibility of combinations of ingredients may also be taken into account, for example to avoid incompatibility (such as bleaching agents and enzymes).

Influencing the operating mode of the household appliance may, for example, include selecting a specific (e.g. pre-programmed) program, running additional programs, influencing the program time (e.g. lengthening or shortening), changing individual parameters of the cleaning program (in the case of a washing machine, for example, the temperature, spin speed, or similar).

In addition or alternatively, it is possible not only to control and/or regulate the household appliance (automatically), taking into account in particular the data acquired by the acceleration sensor, but also to give the user a recommendation. For example, it is possible that in addition to an automated adjustment of the household appliance, manual pre-treatment (of clothing, for example) may also be necessary. Such a recommendation may be indicated or communicated to the user, for example, by employing a display device as described above.

In a further embodiment according to all aspects of the present disclosure, the output module and/or the sensor module are configured to carry out communication with at least one server, whereby the communication may be used in particular for transmitting feedback data (e.g. indicative of a status of the device, such as mechanical condition and/or a cleaning program carried out by the household appliance).

The at least one server is, for example, a remote server. This at least one remote server is, for example, connected to a communication network (e.g. the Internet). The output module and/or the sensor module, for example, may communicate with the server via this communication network. The communication between the output module and/or the sensor module and the at least one server is in particular bidirectional communication. To enable communication with the server, the communication interface of the device is configured, for example, to establish a connection with this communication network (e.g. the Internet).

An embodiment according to all aspects of the present disclosure provides that a user profile may be generated at least partially based on the feedback data, whereby the user profile comprises one or more information specifying the user.

The one or more information specifying the user is indicative for one or more of the following parameters i) to ix), for example:

i) one or more items of information relating to the cleaning products used by the user;
ii) one or more items of information concerning the extent (frequency, regularity, rate or the like) of the user's use of the household appliance;
iii) one or more items of information concerning the quantity of each load during a cleaning operation of the user's household appliance;
iv) one or more items of information concerning the time (date, time, day of the week) of use of the household appliance by the user;
v) one or more items of information concerning the quantity of detergent used;
vi) one or more items of information concerning the type of cleaning program chosen by the user of the household appliance;
vii) one or more items of information concerning a recommendation to the user on the detergent to be used;
viii) one or more items of information concerning the energy costs incurred by the use of the household appliance; and
ix) one or more items of information concerning an optimization of a cleaning strategy to achieve an improved cleaning result.

A further embodiment according to all aspects of the present disclosure stipulates that it is determinable, at least partially based on the sensor data, whether or not the device is configured in the treatment chamber of the household appliance, whereby in particular the determination may be carried out by employing an artificial neural network.

For example, the sensor data may be communicated (e.g. transmitted) to a server which comprises an artificial neural network or is connected to it. Determining whether or not the device is located in a treatment chamber of the household appliance may subsequently be performed, for example, by employing the artificial neural network. The result may then be communicated to the device and/or, for example, the household appliance.

The artificial neural network includes, for example, an evaluation algorithm, so that, for example, training cases may be learned from as examples and, after completion of the learning phase, these may be generalized as a basis for determining a result. This means that the examples are not simply learned by heart, but patterns and regularities in the learning data are recognized. Different approaches may be followed for this purpose. For example, supervised learning, partially supervised learning, unsupervised learning, reinforced learning and/or active learning may be used. Supervised learning may, for example, be carried out using an artificial neural network (e.g. a recurrent neural network) or a support vector machine. Unsupervised learning may also be carried out by employing an artificial neural network (e.g. an auto encoder). The learning data are, for example, sensor data received several times or the output variables (or results) of the artificial neural network determined after one run.

It is also possible that the repeated receipt and/or determination of sensor data or output variables are used for machine learning. Thus, for example, the user profile or one or more items of information included in the user profile may be determined at least partially based on machine learning.

These measures may increase the reliability of the determination of an open-loop and/or closed-loop control of the device and/or the household appliance and subsequently in particular the treatment by the household appliance, in particular for the removal of soiling.

Each of the training cases may be given by an input vector, sensor data and an output vector of the artificial neural network.

Each training case of the training cases may, for example, be generated by converting the control and/or regulation of the device and/or the household appliance associated with the training case, as well as the dispensing or triggering of the output of a preparation into the treatment chamber of the household appliance into a predetermined state (e.g. defined soiling in the treatment chamber of the household appliance), and subsequently generating sensor data representative of sensor data characteristic of the condition of the treatment chamber, and simultaneously carrying out an analysis of the condition of the treatment chamber of the household appliance, e.g. manually. The determined sensor data is transmitted as an input vector, the (actual) condition of the treatment chamber of the household appliance as an output vector of the training case.

The artificial neural network may, for example, be used to derive or determine further data from the specific sensor data, e.g. whether a cleaning program has been completed or terminated, to count the number of rinsing cycles carried out, to weigh up against the number of rinsing cycles included in the cleaning program carried out, or the like, to name but a few non-limiting examples. At least partly based on data derived from the artificial neural network, e.g. control and/or regulation of the household appliance and/or data may be communicated to e.g. the household appliance for distribution to a user.

In an embodiment incorporating all aspects of the present disclosure, the temperature range envisaged for the treatment chamber of the household appliance during a treatment is from about 20° C. to about 150° C., in particular from about 20° C. to about 75° C. or from about 30° C. to about 60° C.

In a further embodiment of the device according to the first and/or second aspect, the output module is designed to carry out and/or prevent the dispensing and/or effecting of the output of a preparation by the output module at least based on the sensor data acquired by the sensor module.

It is also possible to detect and/or obtain storage container data. The detection of storage container data (of the preparation stored by the device) is to be understood, for example, as meaning that storage container data is acquired by the output module or by employing the output module. For example, the detection of the storage container data may be based on sensor data.

For example, obtaining the storage container data is to be understood as receiving and/or reading of the storage container data by the output module or a communication interface of the output module.

The storage container data represents, for example, a characteristic property of the storage container. By storage container data which is characteristic of a property of a storage container is meant, for example, data which represents and/or contains one or more details about a maximum date of use of the storage container, about the spatial configuration of the storage container, about a volume and/or a filling quantity of the storage container and/or for identifying the storage container or the type of storage container.

Furthermore, the storage container data may represent an application specification for a preparation contained in the storage container. For example, such application specification may contain and/or represent one or more indications of a recommended dosage of the preparation for a particular application. Alternatively or in addition, storage container data which represents an application specification for a preparation contained in the storage container should also be understood to mean data which identifies the output control data and/or at least partially represents and/or contains the output control data.

Alternatively or additionally, the storage container data represents a property of a preparation contained in the storage container, such as washing and/or cleaning agents. Such storage container data, which is characteristic of a property of a preparation contained in a storage container, is to be understood, for example, as data which represents and/or contains one or more indications of a chemical and/or physical property of the preparation, of the type of preparation and/or for identification of the preparation. By a chemical and/or physical property is meant, for example, a chemical and/or physical composition of the preparation and/or the physical condition of the preparation (e.g. solid, liquid or gaseous). For example, the storage container data represents values of one or more physical and/or chemical quantities (e.g. one or more values of physical and/or chemical quantities describing one or more properties of the preparation). An indication of a type of preparation comprising a detergent and/or cleaning agent indicates for example whether it is a heavy-duty detergent, a mild detergent, a coloreds detergent, disinfectant and/or another type of detergent and/or cleaning agent and/or which ingredients and/or builder composition the detergent and/or cleaning agent has. An example of an indication for the identification of the preparation is, for example, an identifier for the identification of the preparation such as a product name and/or a product number.

The device further includes, for example, a storage container. Such a storage container is configured, for example, to contain a preparation (e.g. a certain amount of a detergent and/or cleaning agent). For example, the storage container has one or more storage compartments to hold the preparation. If the storage container has several storage compartments, each of the storage compartments may, for example, contain a different preparation such as a different detergent and/or cleaning product and/or a different mixture of detergents and/or cleaning agents. For example, the storage container may have a specific spatial shape (e.g. cube-shaped, spherical and/or plate-like). For example, the storage container may be at least partially dimensionally stable. Alternatively or additionally, the storage container may, for example, be at least partially flexible, for example as a flexible packaging material (e.g. as a tube and/or a bag). It is understood that the storage container may also be designed as an at least partially flexible container surrounded by an at least partially dimensionally stable receptacle, for example as a bag in a substantially dimensionally stable frame.

The preparation, in particular a washing and/or cleaning agent is contained in the storage container, for example in solid, liquid and/or gaseous form. For example, the preparation is a pure substance and/or a mixture of substances. A solid preparation, such as a detergent and/or cleaning agent, may be contained in the storage container, for example in powder, tablet and/or tab form. A liquid preparation may, for example, be contained in the storage container as a gel, concentrated and/or diluted solution. It is understood that the preparation may also be contained in the storage container as foam, rigid foam, emulsion, suspension and/or aerosol. Non-concluding examples of preparations or detergents and/or cleaning agents and/or their ingredients are one or more components from a group of components comprising surfactants, alkalis, builders, graying inhibitors, optical brighteners, enzymes, bleaching agents, soil release polymers, fillers, plasticizers, fragrances, dyes, care substances, acids, starch, isomalt, sugar, cellulose, cellulose derivatives, carboxymethyl cellulose, polyetherimide, silicone derivatives and/or polymethylimines Other non-exhaustive examples of exemplary ingredients are bleach activators, complexing agents, builders, electrolytes, non-aqueous solvents, pH-adjusting agents, perfume carriers, fluorescent agents, hydrotropes, silicone oils, bentonites, anti-redeposition agents, anti-shrinking agents, anti-crease agents, color transfer inhibitors, antimicrobial agents, germicides, fungicides, antioxidants, preservatives, corrosion inhibitors, anti-static agents, bittering agents, ironing aids, phobic or impregnating agents, swelling or slipping agents and/or UV absorbers.

The storage container is, for example, connected and/or connectable to the output module. Preferably the storage container is detachably connected and/or detachably connectable to the output module. A detachable connection is, for example, a connection in which the storage container and the output module may be connected and disconnected non-destructively. For example, more than one storage container is simultaneously connected and/or connectable to the output module. For example, the storage container may be mechanically connected and/or connectable to the output module. For example, the output module and the storage container have corresponding connection features for establishing a connection between the storage container and the output module. The connection may be positive, for example, in the form of a locking mechanism. Alternatively or additionally, the connection may be non-positive, for example in the form of a screw and/or Velcro connection. Alternatively or additionally, the connection may be a material-locking connection, for example in the form of an adhesive connection.

Furthermore, the connection between the storage container and the output module may be used to transport the preparation from the storage container to the output module. For example, the employing connection are designed to provide a liquid-tight, vapor-tight and/or gas-tight connection for transporting the preparation from the storage container to the output module. Examples of connecting features for making such a connection are a tube (e.g. a tube of the storage container) and a membrane (e.g. a membrane of the output module) and/or Luer connectors and/or Luer couplings.

If more than one storage container is simultaneously connected and/or connectable to the output module, the storage containers may alternatively or additionally also be connected and/or connectable to each other. For example, at least those storage containers that are connected to the output module may also be connected and/or connectable to each other.

For example, the output control data specifies one or more output parameters. Examples of an output parameter are an output quantity, an output time, output temperature and/or output duration. For example, an output parameter specifies an output quantity, an output time, output temperature and/or output duration for output. The fact that the output control data is configured to at least partially control the output by the output module is to be understood, for example, as meaning that the output control data causes the output module to output the preparation according to the output parameters specified by the output control data.

Determining the output control data at least partially dependent on the storage container data is to be understood, for example, as meaning that the output control data is selected and/or calculated at least partially dependent on the storage container data. For example, the output control data is determined by the output module, the sensor module and/or a further device (for example a server device). For example, the determination of the output control data is at least partially based on the sensor data.

Accordingly, effecting the determination of the output control data shall be understood to mean, for example, that the output module causes the output control data to be determined by a device other than the output module (e.g., a server device). For example, the storage container data is sent by the output module to the server device to cause the server device to determine the output control data.

As disclosed above, the output control data may specify one or more output parameters. For example, the output module is configured to output the preparation contained in the storage container according to the output parameters specified by the output control data and/or to cause the output of the preparation contained in the storage container (e.g., by the storage container) according to the output parameters specified by the output control data when the storage container is connected to the output module.

For example, the output module comprises a control unit and at least one actuator, wherein the control unit is configured to control the actuator. For example, the control unit is configured to control the actuator in such a way that a movement of the actuator is affected. For example, the movement of the actuator causes a preparation to be dispensed. For example, the control unit is configured to control the actuator in such a way that the preparation is dispensed in accordance with the output parameters specified by the output control data and/or the output of the preparation contained in the storage container (e.g. by the storage container) is effected in accordance with the output parameters specified by the output control data.

An actuator is to be understood as a movable component of the output module. For example, the actuator is configured in such a way that, when it moves and the storage container is connected to the output module, it causes the preparation to be dispensed. Examples of an actuator are a pump (e.g. a peristaltic pump), a valve and/or a motor (e.g. a linear motor). If the actuator is a pump, the control unit controls the pump for outputting the preparation, for example, in such a way that the pump transports the preparation from the storage container to an output opening (e.g. an output opening of the storage container and/or the output module). If the actuator is a valve, the valve is configured, for example, to close an output opening (e.g. an output opening of the storage container and/or the output module). To output the preparation, the control unit controls the valve, for example, so that the valve opens so that the preparation may flow out of the output opening.

Furthermore, a use of an acceleration sensor in a dosing device and/or a sensor device, in particular a device according to the first aspect of the present disclosure for a household appliance is disclosed, wherein an acceleration sensor is configured to determine sensor data characteristic for the condition of the treatment chamber of the household appliance and/or the device, and wherein the sensor data at least partially represents data determined by employing the at least one acceleration sensor. The acceleration sensor or the device comprising the acceleration sensor may be designed according to individual or several features described above.

In particular, the previous or following description of method steps according to preferred embodiments of a method should also reveal corresponding features for carrying out the method steps by preferred embodiments of a device. Likewise, by the disclosure of employing a device for performing a method step, the corresponding method step shall also be disclosed.

Further advantageous exemplary embodiments of the present disclosure are shown in the following detailed description of some exemplary embodiments of the present disclosure, especially in connection with the Figures. The Figures, however, are only intended to clarify, but not to determine the scope of protection of the present disclosure. The Figures are not to scale and are merely intended to illustrate the general concept of the present disclosure. In particular, features included in the Figures are not intended to be considered as a necessary element of the present disclosure.

FIG. 1 shows first of all a schematic representation of an embodiment of a System 1 as contemplated herein comprising the devices 100, 200, 300 and 400. System 1 is configured to execute exemplary methods as contemplated herein. Device 100 is an exemplary mobile device 100, which in this case may be placed in the treatment chamber 310 of the household appliance 300 (here exemplarily configured as a washing machine). Both the device 100 and the washing machine 300 may each be a device as contemplated herein. Furthermore, System 1 comprises as a further device mobile device 200 in the form of a smartphone, tablet, wearable, or the like (here exemplarily configured as a smartphone). Mobile device 200 may also be a device as contemplated herein or may perform individual steps of exemplary methods as contemplated herein. However, device 200 may also be a computer, a desktop computer or a portable computer, such as a laptop computer, a tablet computer, a Personal Digital Assistant (PDA). In addition or alternatively to devices 300 and 200, the system may also include a server 400. It is also conceivable that System 1 may also include fewer or more than three devices.

While the examples described here are described in particular in connection with household appliance 300 in the form of a washing machine, the explanations also apply analogously to other types of household appliances.

Each of the devices 100, 200, 300, 400 may have a communication interface to communicate and/or to exchange data with one or more of the other devices, e.g. directly via a wireless (Bluetooth, WLAN, ZigBee, NFC, to name but a few non-limiting examples) and/or wired (LAN) connection, and/or via a communication network 118, such as the Internet, and/or a local network covering the devices 100, 200, 300.

Figure 2:
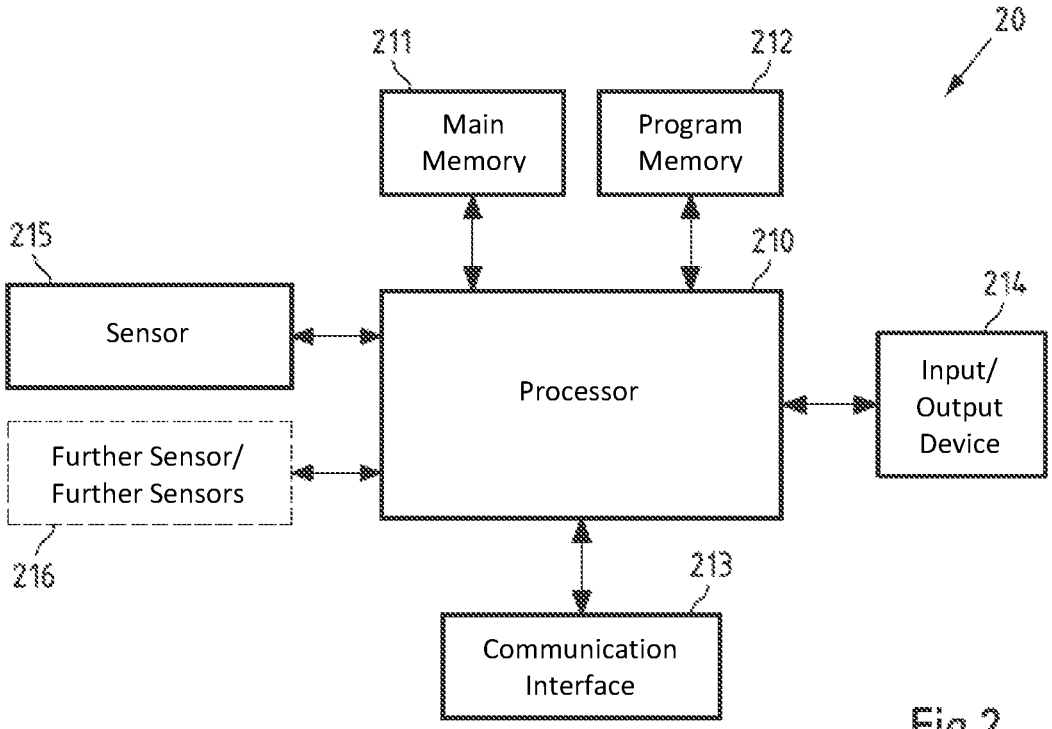
FIG. 2 shows a block diagram of an embodiment of a device as contemplated herein for carrying out an embodiment of a method as contemplated herein.

FIG. 2 shows a block diagram 20 of an embodiment of a device as contemplated herein for the execution of an embodiment of a method as contemplated herein. The block diagram 20 in FIG. 2 may be an example of either device 100 shown in FIG. 1, washing machine 300 shown, mobile device 200 (or part thereof) shown, or server 400 shown.

Processor 210 of device 20 is designed in particular as a microprocessor, micro-controller unit, micro-controller, Digital Signal Processor (DSP), Application-Specific Integrated Circuit (ASIC) or Field Programmable Gate Array (FPGA).

Processor 210 executes program instructions stored in program memory 212 and stores, for example, intermediate results or the like in the working or main memory 211. Program memory 212 is, for example, a non-volatile memory such as a flash memory, a magnetic memory, an EEPROM memory (Electrically Erasable Programmable Read-Only Memory) and/or an optical memory. Main memory 211 is, for example, a volatile or non-volatile memory, in particular a Random Access Memory (RAM) such as a Static RAM memory (SRAM), a Dynamic RAM memory (DRAM), a Ferroelectric RAM memory (FeRAM) and/or a Magnetic RAM memory (MRAM).

Program memory 212 is preferably a local data storage medium firmly connected to device 20. Data storage media permanently connected to device 20 is, for example, hard disks which are built into device 20. Alternatively, the data storage medium may, for example, also be a data storage medium that is detachably connectable to device 20.

Program memory 212 contains, for example, the operating system of device 20, which is at least partially loaded into main memory 211 when the device 20 is started and is executed by processor 210. In particular, when device 20 is started, at least part of the core of the operating system is loaded into main memory 211 and executed by processor 210.

In particular, the operating system allows the use of device 20 for data processing. For example, it manages resources such as main memory 111 and program memory 212, communication interface 213, input and output device 214, provides basic functions to other programs through programming interfaces and controls the execution of programs.

Processor 210 further controls communication interface 213, which may, for example, be a network interface and may be designed as a network card, network module and/or modem. Communication interface 213 is configured in particular to establish a connection of device 100 with other devices, in particular via a (wireless) communication system, for example a network, and to communicate with them. Communication interface 213 may, for example, receive data (via the communication system) and forward it to processor 210 and/or receive data from processor 210 and send it (via the communication system). Examples of a communication system are a local area network (LAN), a wide area network (WAN), a wireless network (e.g. according to the IEEE 802.11 standard, the Bluetooth (LE) standard and/or the NFC standard), a wired network, a mobile network, a telephone network and/or the Internet. For example, communication is possible with the Internet and/or other devices using the communication interface 213. In the case of devices 100, 200, 300, 400, communication interface 213 may be used to communicate with the other devices 100, 200, 300, 400 or the Internet.

Via such a communication interface 213, in particular, sensor data characterizing the condition and the load condition of a treatment chamber of a household appliance (e.g. washing machine 300 according to FIG. 1) may be obtained (received). Furthermore, the displayed components (and other components, if required) may be used to control and/or regulate a household appliance (e.g. washing machine 300 according to FIG. 1) and/or the device (e.g. device 100 according to FIG. 1), taking into account the sensor data received.

Furthermore, processor 210 may control at least one input/output device 214. Input/output device 214 is, for example, a keyboard, a mouse, a display unit, a microphone, a touch-sensitive display unit, a loudspeaker, a reader, a drive and/or a camera. For example, input/output device 214 may receive input from a user and forward it to processor 210 and/or receive and output data for the user from processor 210.

Finally, device 20 may include at least one conductivity sensor 215, and optionally one or more additional sensors 216. One of the one or more additional sensors is, for example, an acceleration sensor, a temperature sensor, and/or an optical sensor, to name but a few non-limiting examples. Other sensors disclosed in the general description of this specification may of course also represent one or more of the other sensors 216.

Figure 3:
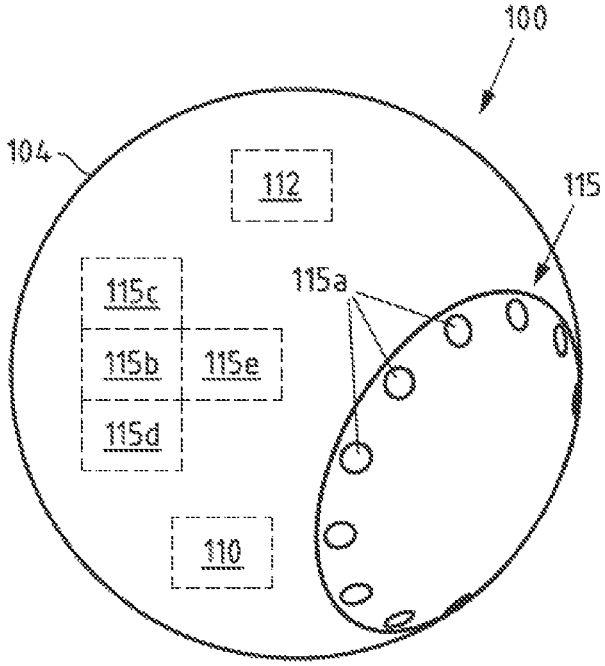
FIG. 3 shows a schematic representation of device 100 according to FIG. 1 in perspective view.

FIG. 3 now shows a schematic representation of the device 100 according to FIG. 1 in perspective view. Device 100 is a separate device from the washing machine 300. Device 100 has an essentially spherical, watertight casing, which is at least partially made of a non-rigid or elastic material. Device 100 includes, for example, a supply of preparation, such as detergent or individual detergent components to be combined as required (not shown). The detergent or the individual detergent components may be dispensed into the interior (the treatment chamber 310) of washing machine 300 by employing pump unit 115 via the outlet openings 115*a* during the operation of washing machine 300. This is because device 100 is designed to be placed in the washing drum of washing machine 300 and to be freely mixed with the laundry in it.

Device 100 may also be designed to send control signals to washing machine 300 for control and/or regulation, for example to influence the program sequence of the washing machine.

Device 100 has a casing 104, whereby the casing 104 is designed to be placed in a treatment chamber 310 of a household appliance 300. In FIG. 1, the devices are not shown to scale, in particular casing 104 or device 100 is of a size that allows casing 104 or device 100 to be inserted and removed into and from treatment chamber 310.

Casing 104 of device 100 has an output module 110 which is designed to dispense at least one preparation into treatment chamber 310 of household appliance 300 and/or to trigger an output. For example, the preparation is dispensed through an output opening of output module 110 and/or a storage container to the surroundings of output module 110 and/or the storage container and thus reaches in particular treatment chamber 310.

Casing 104 of device 100 comprises a sensor module 112 which is configured to determine sensor data characteristic of the condition of treatment chamber 310 of household appliance 300 and/or device 100. Furthermore, sensor module 112 is configured to determine sensor data which is further indicative of a load condition of treatment chamber 310 of domestic appliance 300. Sensor module 112 comprises a sensor 115*b*, which is, for example, designed as a conductivity sensor. Furthermore, the sensor module may comprise one or more further sensors 115*c* to 115*e*, each of which is comprised by and/or electrically connected to the sensor module 112, such as an optical sensor 115*c*, an acceleration sensor 115*d*, and a temperature sensor 115*e*.

Device 100 is in wireless communication with household appliance 300, for example via communication network 118. Further devices may be integrated into the communication, for example a server (e.g. server 400 according to FIG. 1), which in particular controls and/or regulates individual or several method steps of the treatment in household appliance 300.

For example, a cleaning program is monitored at least partially based on sensor data acquired by sensor module 112. In particular, the cleaning program is controlled and/or influenced at least partially on the basis of the sensor data. The cleaning program may, for example, include initiating the dispensing of a preparation by the output module, in particular via a storage container. For example, a washing and/or cleaning agent is output depending on the sensor data.

To save electrical energy or the capacity of an energy storage device (not shown in FIG. 3), output module 110 and/or sensor module 112 may be configured to communicate with household appliance 300 at least based on the sensor data acquired by sensor module 112. Furthermore, output module 110 may be configured to carry out the dispensing and/or effecting of the output of a preparation by output module 110 at least based on the sensor data acquired by sensor module 112. For example, communication and/or output are only carried out if the movement of treatment chamber 310 and/or device 100 (for example the acceleration and/or speed) are within respective permissible ranges. This may, for example, be carried out via reference values stored in a database (e.g. included by or connected to server 400 according to FIG. 1). Communication and/or output may be prevented if, for example, the respective parameters are outside the permissible ranges, which may be defined by reference values.

Figure 4:
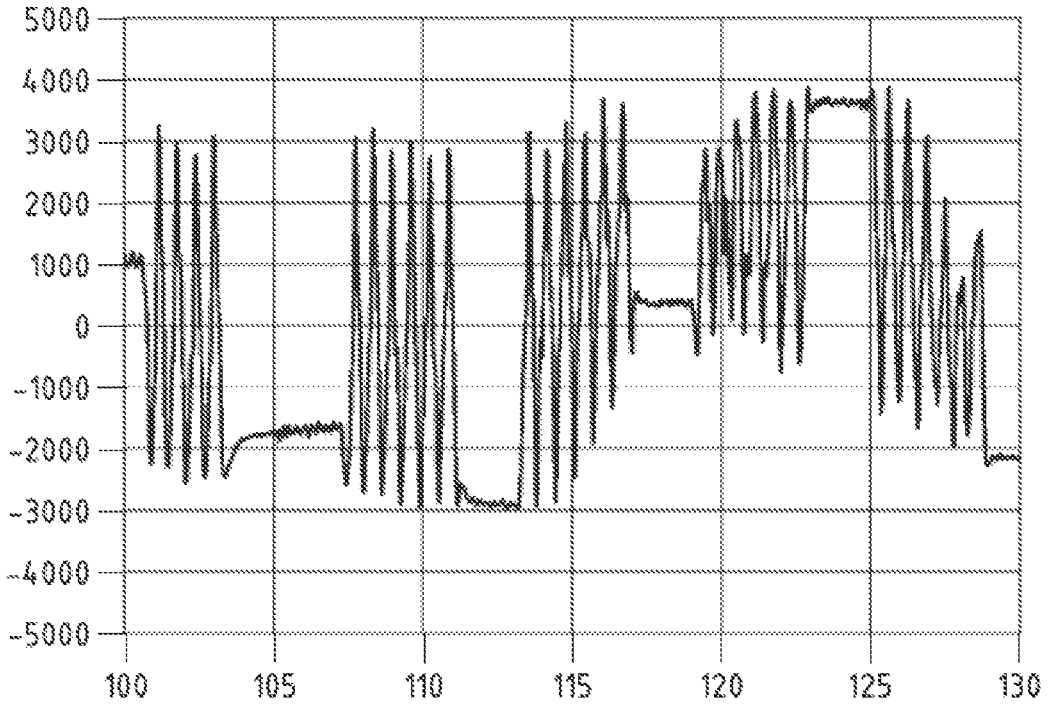
FIG. 4 shows a first item of sensor information determined by a magnetometer, e.g. comprised by device 100 according to FIG. 1, which in the present case represents a curve.

The following exemplary embodiments according to all aspects of the present disclosure shall also be understood as disclosed:

FIG. 4 shows (sensor) data determined by a magnetic field sensor encompassed by a metering device (e.g. device 100 according to FIG. 1) or its curve progression. The curve represented by the data was determined for a household appliance designed as a washing machine (e.g. household appliance 300 according to FIG. 1), the drum of which (e.g. treatment chamber 310 according to FIG. 1) was fully loaded (i.e. with max. filling quantity; 100%). It can be seen that a uniform, harmonious vibration behavior (corresponding to a rotation of the drum, e.g. in the context of a cleaning program carried out by the washing machine) is represented by the curve. If such a curve is detected by the magnetic field sensor, regardless of the spatial axis (e.g. x-, y- and/or z-axis), it is clearly possible to determine or recognize that the drum is rotating and a washing or drying process has been started. With this data acquired over a certain time (period), the determined data may also be associated with a point in time (e.g. a time stamp). According to, for example, a dosing matrix, a corresponding detergent may be dosed by the dosing device.

Furthermore, the curve shown in FIG. 4 also clearly shows breaks in movement. The drum stands still and accordingly the metering unit does not move relative to the drum or not at all. These pauses may occur at certain intervals, which are also referred to as pause behavior, whereby these certain intervals may be characteristic of many cleaning programs of a household appliance (in this case the washing machine) and may thus serve to identify (e.g. by employing an analysis and a database query in a so-called look-up table) the cleaning program carried out by the household appliance.

Figure 5:
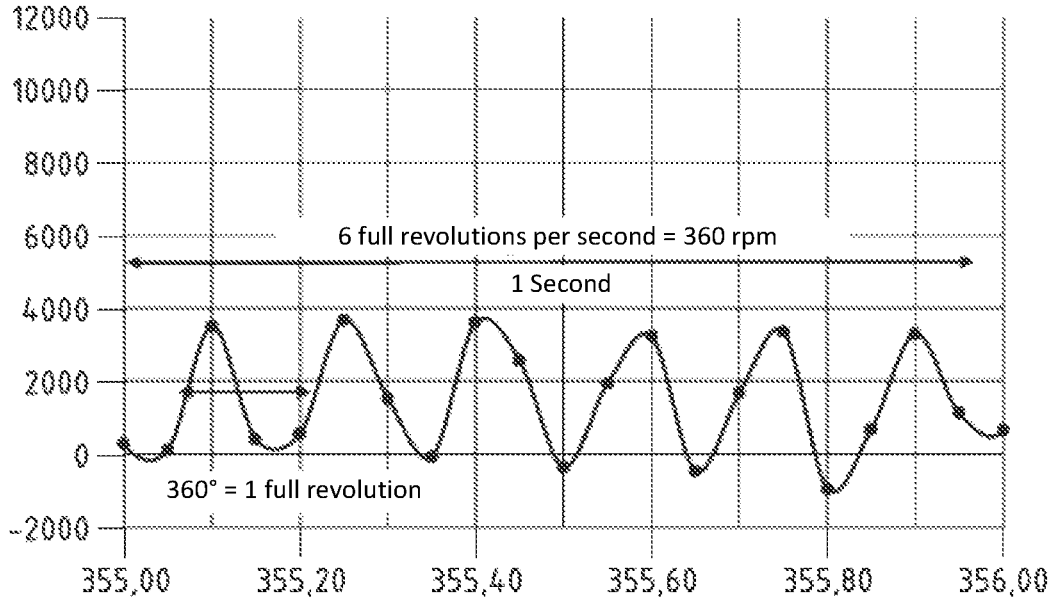
FIG. 5 shows a second item of sensor information determined by a magnetometer, e.g. comprised by device 100 according to FIG. 1, which presently represents a curve progression.

FIG. 5 shows (sensor) data determined by a magnetic field sensor, which is included in a dosing device (e.g. device 100 according to FIG. 1), or its curve progression. The curve represented by the data was determined for a household appliance designed as a washing machine (e.g. household appliance 300 according to FIG. 1), whereby only one third of the drum (e.g. treatment chamber 310 according to FIG. 1) was loaded (e.g. with 2 kg of laundry from a max. load of 6 kg, to name just one non-limiting example).

For example, in order to determine whether a spin cycle is taking place as part of a cleaning program carried out by the washing machine, or to determine the rotational speed of the treatment chamber, the data determined by the magnetic field sensor may be evaluated to determine this. This is not possible with an acceleration sensor, for example, because the centrifugal forces are too high and exceed the measuring range of the acceleration sensor. For example, in a conventional washing machine with a load volume of about 6 kg of laundry (e.g. with a drum diameter of about 47 cm), an acceleration of about 42 G is achieved at a spinning speed of about 400 rpm, and about 378 G at about 1200 rpm. This cannot be measured by acceleration meters based on MEMS (Micro-Electro-Mechanical Systems). A magnetic field sensor such as a MEMS-based magnetometer, on the other hand, is capable of detecting even the smallest changes relative to the earth's magnetic field. This makes it possible to detect any speed in a washing machine or dryer. In addition to determining the absolute speed, a change in speed may also be determined.

In FIG. 5, for example, it can be seen that a harmonic sinusoidal oscillation clearly correlates with the speed of the drum. The time window shown in FIG. 5 is 1 second, whereby the curve was determined with a sampling rate of about 20 Hz. A certain sampling rate is required for a correct determination and thus a determination (e.g. calculation) of the speed of the drum, because only with a sufficient amount of information (e.g. amount of data), especially higher speeds of the drum may be clearly determined. For example, to determine one full revolution of the drum, at least two, preferably three, and particularly preferably four measured values of the data determined should be acquired at regular intervals. For example, at a speed of about 1600 rpm, a value of about 26.667 revolutions of the drum per second is available. Consequently, it is possible to reliably describe a sinusoidal curve resulting from a drum speed of about 1600 rpm at a sampling rate of, for example, at least about 50 Hz, preferably up to at least about 110 Hz.

Figure 6:
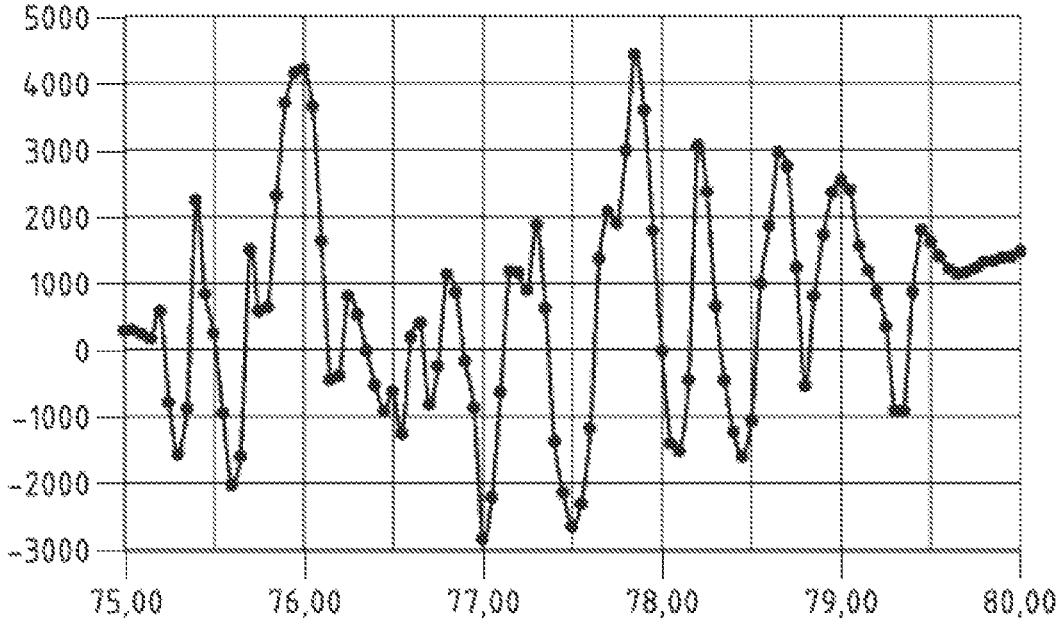
FIG. 6 shows a third item of sensor information determined by a magnetometer, e.g., comprising device 100 according to FIG. 1, which presently represents a curve shape.

FIG. 6 shows data determined by a magnetic field sensor, which is included in a dosing unit (e.g. device 100 according to FIG. 1), or its curve progression. The curve represented by the data may, for example, also be evaluated in such a way that, in the case of a household appliance designed as a washing machine (e.g. household appliance 300 according to FIG. 1), the degree of filling (e.g. in %) is determined.

The curve shown in FIG. 6 was determined based on a drum with a maximum possible load capacity of about 6 kg load with about 2 kg load in the course of a main wash cycle of a cleaning program at approx. 50 to about 55 rpm.

The dosing device (e.g. spherical design) moves freely in the drum of the washing machine. There is no harmonic sinusoidal oscillation. This behavior is characteristic for a load of less than about 50% of the maximum possible load of the drum. With larger load quantities up to about 100% of the maximum possible load quantity of the drum, the behavior (or movement) of the dosing unit inside the drum changes and the oscillation behavior becomes harmonious, whereby this is represented, for example, by a sinusoidal curve.

Figure 7:
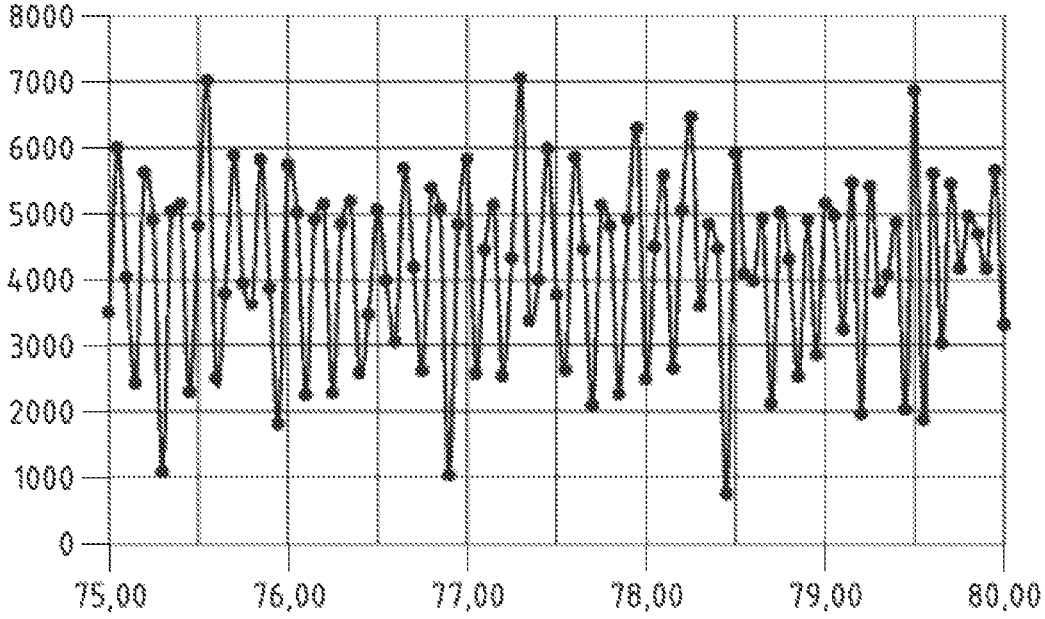
FIG. 7 shows a fourth item of sensor information determined by a magnetometer, e.g. comprised by device 100 according to FIG. 1, which in this case represents a curve.

FIG. 7 shows further (sensor) data determined by a magnetometer, e.g. comprised by a device 100 according to FIG. 1, which in this case represents a curve. The curve shown in FIG. 7 was determined on the basis of a drum with a maximum possible load capacity of about 6 kg of laundry with this maximum load (presently about 6 kg of laundry) in the course of a main wash cycle of a cleaning program at from about 50 to about 55 rpm. It can be seen that in comparison to FIG. 6 a change towards a sinusoidal (harmonic) curve has taken place.

Although data determined in this way does not enable an exact determination of the filling quantity of a treatment chamber of a household appliance at least partially based on a device which may be placed in the treatment chamber, the data determined is nevertheless indicative, for example, in order to adapt a dosage of preparation to the load quantity of the treatment chamber. Furthermore, the determined (sensor) data may be combined with further determined data, e.g. determined by one or more further sensors included in the device, e.g. with data determined by an acceleration sensor, in order to secure, confirm or correct the determined data of the magnetic field sensor.

The embodiments of the present disclosure described in this specification and the optional features and characteristics mentioned in each case shall also be understood as disclosed in all combinations with each other. In particular, unless explicitly stated otherwise, the description of a feature included in an embodiment shall not be understood in the present case to mean that the feature is indispensable or essential for the function of the example. The sequence of the method steps described in this specification in the individual flowcharts is not mandatory; alternative sequences of method steps are conceivable. The method steps may be implemented in various ways, for example, implementation in software (through program instructions), hardware, or a combination of both to implement the method steps is conceivable.

Terms used in the Claims such as "comprising", "having", "containing", "including" and the like do not exclude further elements or steps. The expression "at least partially" covers both the "partially" case and the "completely" case. The wording "and/or" should be understood to mean that both the alternative and the combination should be disclosed, i.e. "A and/or B" means "(A) or (B) or (A and B)". The use of the indefinite article does not exclude a plural. A single device may perform the functions of several units or devices mentioned in the Claims. Reference marks indicated in the Claims are not to be regarded as limitations of the elements and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A device for use in a household appliance, the device comprising:

at least one casing, wherein the casing is configured to be placed in a treatment chamber of a household appliance;

wherein the casing comprises:

at least one output module configured to dispense an amount of at least one preparation into the treatment chamber of the household appliance and/or to trigger an output of the preparation;

and at least one sensor module in operable communication with the at least one output module and configured to sense a condition of the treatment chamber of the household appliance and/or the device and supply sensor data indicative thereof, wherein said sensor module comprises at least one magnetic field sensor configured to supply magnetic field sensor data;

wherein the sensor data includes the magnetic field sensor data supplied by the magnetic field sensor, wherein the output module or the sensor module are further configured to analyze the magnetic field sensor data to determine a load condition of the treatment chamber of the household appliance, wherein the load condition represents a load quantity of objects placed in the treatment chamber of the household appliance; and wherein the dispensing and/or the triggering of the output of the preparation by the at least one output module, the amount of the preparation, and a composition of the preparation are at least partially based on the load condition determined by the output module or the sensor module.

2. The device according to claim 1, wherein the sensor data supplied by the at least one sensor module further includes data that is at least partially indicative of a status of a cleaning program performed by the household appliance.

3. The device according to claim 2, wherein the sensor data supplied by the at least one sensor module further includes data that is at least partially indicative of a liquid level of the treatment chamber of the apparatus.

4. The device according to claim 2, wherein the magnetic field sensor data is an oscillation behavior of the magnetic flux density measured by the magnetic field sensor, wherein the load condition of the treatment chamber is determined by an analysis of the oscillation behavior, wherein a harmonic sinusoidal oscillation is recognized as indicative of a drum loaded over about 50%, and a disharmonic sinusoidal oscillation is recognized as indicative of a drum loaded less than about 50%.

5. The device according to claim 1, wherein the sensor data supplied by the at least one sensor module further includes data that is at least partially indicative of a liquid level of the treatment chamber of the apparatus.

6. The device according to claim 5, wherein the magnetic field sensor data is an oscillation behavior of the magnetic flux density measured by the magnetic field sensor, wherein the load condition of the treatment chamber is determined by an analysis of the oscillation behavior, wherein a harmonic sinusoidal oscillation is recognized as indicative of a drum loaded over about 50%, and a disharmonic sinusoidal oscillation is recognized as indicative of a drum loaded less than about 50%.

7. The device according to claim 1, wherein the magnetic field sensor data is an oscillation behavior of the magnetic flux density measured by the magnetic field sensor, wherein the load condition of the treatment chamber is determined by an analysis of the oscillation behavior, wherein a harmonic sinusoidal oscillation is recognized as indicative of a drum loaded over about 50%, and a disharmonic sinusoidal oscillation is recognized as indicative of a drum loaded less than about 50%.

8. The device according to claim 1, wherein the sensor data further includes data that is supplied by one or more further sensors, wherein the one or more further sensors are one or more of the following sensors: temperature sensor, optical sensor, conductivity sensor, and acceleration sensor.

9. The device according to claim 1, wherein the output module and/or the sensor module are further configured to communicate with the household appliance.

10. The device according to claim 9, wherein the output module and/or the sensor module are further configured to perform and/or prevent communication with the household appliance at least based on the magnetic field sensor data acquired by the sensor module.

11. The device according to claim 10, wherein the communication with household appliance comprises transmitting feedback data, wherein the feedback data is indicative of a feedback to the household appliance regarding at least one parameter related to the treatment chamber of the household appliance.

12. The device according to claim 11, wherein a user profile is generated at least partially based on the feedback data, wherein the user profile comprises one or more items of information specifying the user.

13. The device according to claim 1, wherein the output module and/or the sensor module are further configured to perform communication with at least one server.

14. The device according to claim 1, wherein the output module and/or the sensor module are further configured to determine, at least partially based on the sensor data, whether the device is placed in the treatment chamber of the household appliance.

15. The device according to claim 1, wherein the temperature range provided for the treatment chamber of the household appliance during a treatment is from about 20° C. to about 150° C.

16. The device according to claim 1, wherein the output module is further configured to perform and/or prevent dispensing and/or causing output of a preparation by the output module at least partially based on the sensor data acquired by the sensor module.

17. A system comprising a device according to claim 1, wherein the system further comprises at least one household appliance.

* * * * *